US005617598A

United States Patent [19]

Kinzel et al.

[11] Patent Number: 5,617,598

[45] Date of Patent: Apr. 8, 1997

[54] ARMORED BRIDGE-LAYING VEHICLE WITH LAYING MEANS

[75] Inventors: Walter Kinzel, Mainz; Jan Ghering, Ginsheim-Gustavburg, both of Germany

[73] Assignee: MAN Gutehoffnungshütte Aktiengesellschaft, Oberhausen, Germany

[21] Appl. No.: 505,690

[22] Filed: Jul. 21, 1995

[30] Foreign Application Priority Data

Aug. 23, 1994 [DE] Germany ..... 44 29 808.0

[51] Int. Cl.[6] ..... E01D 15/12; E01D 21/06

[52] U.S. Cl. ..... 14/2.4; 14/2.5

[58] Field of Search ..... 14/2.4, 2.5, 2.6

[56] References Cited

U.S. PATENT DOCUMENTS

| | | | |
|---|---|---|---|
| 3,491,391 | 1/1970 | Soffge | 14/2.4 |
| 3,492,683 | 2/1970 | Wagner et al. | 14/2.5 |
| 3,562,829 | 2/1971 | Soffge | 14/2.4 |
| 3,820,181 | 6/1974 | Wagner et al. | 14/2.5 |
| 3,845,514 | 11/1974 | Wagner | 14/2.4 |
| 4,288,881 | 9/1981 | Mahncke et al. | 14/2.5 |
| 4,972,538 | 11/1990 | Parramore | 14/2.4 X |
| 5,067,191 | 11/1991 | Kinzel et al. | 14/2.4 |
| 5,179,751 | 1/1993 | Wiedeck | 14/2.4 |

FOREIGN PATENT DOCUMENTS

| | | | |
|---|---|---|---|
| 1658604 | 2/1967 | Germany | E01D 21/00 |
| 2017489 | 4/1970 | Germany | E01D 15/12 |
| 2116120 | 10/1972 | Germany . | |
| 1908429 | 2/1973 | Germany . | |
| 3891429 | 11/1988 | Germany | E01D 21/00 |
| 4123092 | 7/1991 | Germany | E01D 21/00 |

*Primary Examiner*—James A. Lisehora
*Attorney, Agent, or Firm*—McGlew & Tuttle

[57] ABSTRACT

An armored bridge-laying vehicle with a laying device for bridges or bridge sections located one on top of another, wherein a single laying girder is rotatably mounted on a support ring structure on the tower ring. The laying girder is pivotable around a horizontal pivot bearing, and the pivoting is performed by a piston-and-cylinder unit. Telescopic U-shaped girders are arranged inside the laying girder, and the top edges are located in the same plane as the upper chord edges of the laying girder. The bridge elements are laid by a flanged feeding unit, support rollers and a pivotable arm in the rear of the laying girder.

4 Claims, 3 Drawing Sheets

ARMORED BRIDGE-LAYING VEHICLE WITH LAYING MEANS

FIELD OF THE INVENTION

The present invention pertains to an armored bridge-laying vehicle with a laying means for bridges placed one on top of another or for bridge sections, which can be assembled into a bridge, wherein the laying means is placed on a support ring structure on a tower ring, with a laying girder pivotable around a horizontal axis, with a rear arm arranged on the laying girder, and with telescoping girders arranged inside the laying girder.

BACKGROUND OF THE INVENTION

DE 16 58 604 discloses a bridge-laying device with the corresponding bridge, wherein the vehicle is equipped with means for supporting at least two sections, which can be assembled to a bridge and are placed one on top of another during transportation, as well as with means for assembling and laying the bridge.

The two front sides of the bridge sections to be connected have the same design. At least one cantilever girder is arranged on the vehicle and can be pushed out in the longitudinal direction of the bridle, has means for connection to the bearing-side end of the upper bridge section and is used to displace and lower these sections.

DE 20 17 489 discloses an arrangement of bridge halves, which are arranged one on top of another on a transport vehicle and are connected to one another fully automatically. Claw couplings are arranged on the lower chords of the bridge halves and the claw couplings are able to be pushed vertically into one another. The head ends of the upper chords of the bridge halves coming into contact with one another have pushing strips.

The disadvantage of DE 16 58 604 and DE 20 17 489 is the arrangement of the pivotable arm on the telescopic girder of the laying girder. As a result, it is necessary for the bridge sections to be coupled together into a bridge before the telescopic girder parts can be extended to form the cantilever girder. In addition, a very long flexible hydraulic line is needed to actuate the cylinders of the pivotable arm when it acts as a lowerable accommodating support for the cantilever girder. Each part of the cantilever girder has support and idle rollers, over which the bridge moves.

In a prior-art bridge-laying device according to DE 21 16 120, the device consists of a caterpillar vehicle (tracked vehicle), on whose top side a girder is arranged, which extends in the longitudinal direction of the vehicle, is pivotable at right angles to the longitudinal axis of the vehicle, and consists of a plurality of telescopically extensible girder parts. Two bridge sections, which can be assembled into a bridge, are arranged one on top of another in the longitudinal direction on the girder, and these bridge sections have one end that can be coupled and one free end each. A coupling means is provided for connecting the bridge sections, and a pivotable arm, which is articulated at the rear end of the girder when viewed in the direction of travel of the vehicle, is used as the coupling means.

The drive of this rear arm is designed such that the rear arm either must be pivoted to the rear during travel without bridge to form a low overall height of the armored bridge-laying vehicle, which is unfavorable for the overall length of the empty vehicle, or the rear arm is pivoted up in the forward direction, which is unfavorable when passing through with low obstacles (e.g., overhanging derrick poles).

DE 41 23 092 discloses a bridge-laying device with a telescopic cantilever girder pivotable around an axis, with bridge sections located on top one over the other, which can be assembled into a bridge and are displaceably arranged on the cantilever girder.

Thus, the basic body of the cantilever girder is at least as long as the chassis and is displaced in a sleeve-like laying beam. The laying beam is only about half as long as the chassis, and it is projectingly arranged on its rear-side part. The pivotability of the cantilever girder is achieved by a pivoting mounting of the laying beam with a support, which can be raised and lowered, at its end facing away from the obstacle.

DE 38 91 429 discloses an armored bridge-laying vehicle, which is designed as a cantilever construction girder for laying a bridge.

The disadvantage of this armored bridge-laying vehicle is its high weight, because the laying vehicle must have its own balancing weight. Such a laying vehicle is not always available for each user, and it requires a new purchase or expensive conversions. Furthermore, the folded-up support legs or the support shield restrict the view of the driver or user of the laying vehicle during travel, as do the folded-down support legs during laying.

Moreover, the bridge-laying vehicle must always be set up in the direction of the longitudinal axis of the bridge. This requires an additional alignment time and a larger surface area at the bridge-laying site for the bridge-laying process.

SUMMARY AND OBJECTS OF THE INVENTION

The primary object of the present invention is therefore to provide a bridge-laying device, with which it is possible to make art armored bridge-laying vehicle from a standard tracked vehicle without arranging additional parts necessary for the laying process on the outside of the hull of the armored tracked vehicle.

The invention provides an armored bridge-laying vehicle, comprising a tower ring structure supported on the vehicle with a support ring structure rotatably connected to the tower ring. A laying girder is provided pivotably connected to the support ring structure. A bridge arm is pivotably connected to the laying girder. A plurality of U-shaped telescopic girders are displaceably arranged in the laying girder. Each of the U-shipped girders and the laying girder have an upper cord edge located in a common plane.

The laying girder includes web plates. Movably-mounted support rollers are preferably arranged on a rear web part of the laying girder. The bridge arm is connected for pivotable movement through more than 180 degrees. The arm is disposed adjacent to an upper corner of the leading girder, on a rear side of the leading girder. Preferably the laying girder, including the withdrawn displaceable U-shaped girder, the arm and supported bridge sections are located within a front vehicle wheel slope angle and a rear vehicle wheel slope angle in a transport position of the armored bridge-laying vehicle.

According to the present invention, the upper chords of the displaceable U-shaped girders are in the same plane as the upper chord of the laying girder, so that the running wheels of the bridge can be guided over them unhindered. It was found that disturbances, which are due to jamming and tilting of the support rollers during introduction when the bridge reaches the individual support rollers at the end of the telescopic girder, frequently occur in the case of bridges according to DE 41 23 092, with guide rails in the lower chord.

Another advantage of the present invention is that a rotatably mounted support ring structure of the laying means is placed on the tower ring of the armored bridge-laying vehicle. The time-consuming alignment of the laying vehicle is reduced as a result, and a smaller surface area is required for shunting at the laying site during the laying process than in the prior-art laying means with nonrotatable laying means. It is possible according to the present invention to lay and pick up the bridge in any position of the armored bridge-laying vehicle.

Another embodiment of the present invention is the compact form of the laying girder and the arrangement of the hydraulic jib in the rear of the laying girder.

This rear arm, including drive, is designed such that a low overall height of the bridge-laying vehicle can be achieved during travel without bridge.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
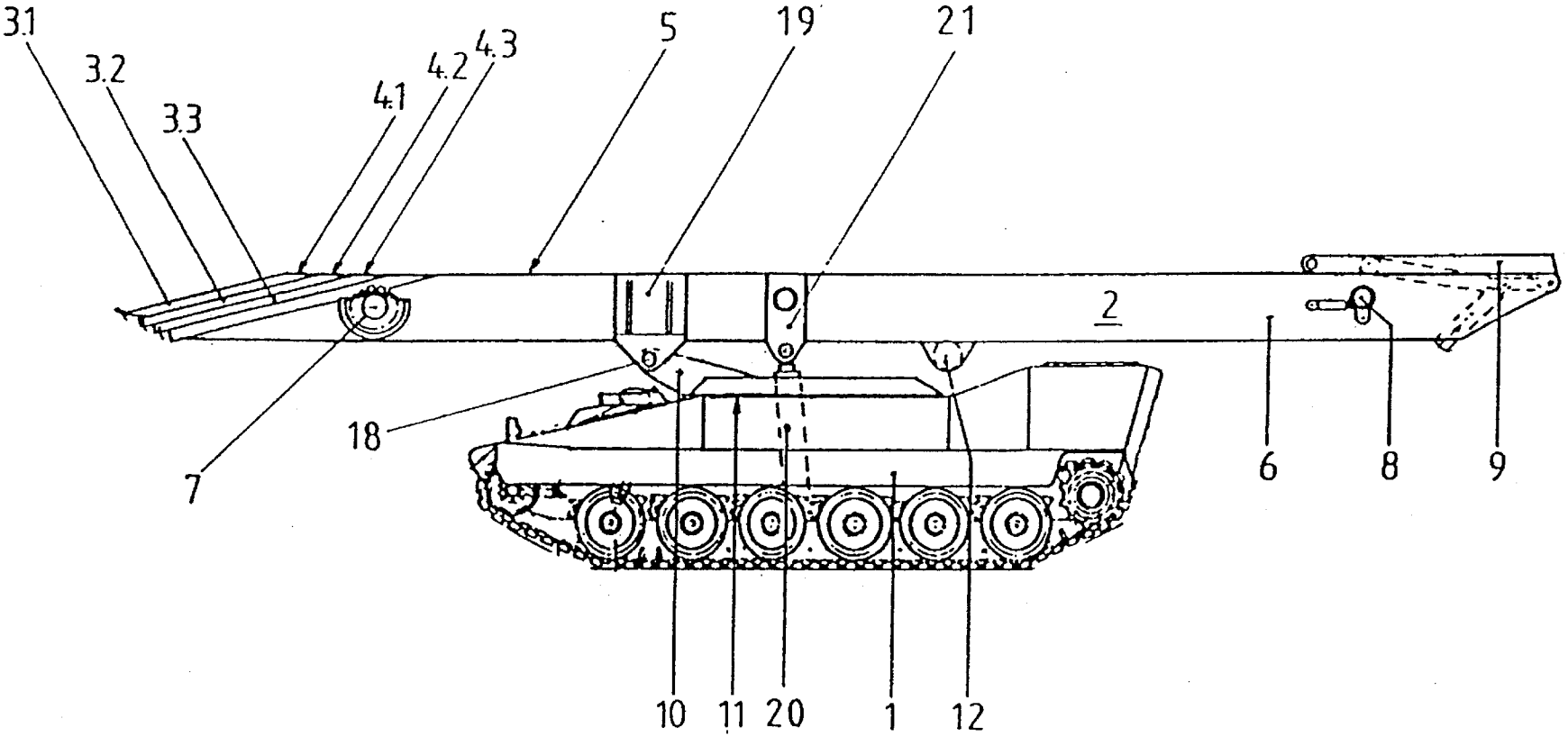
FIG. 1 is a side view of the armored bridge-laying vehicle without bridge sections located one on top of another.

FIG. 1 shows a side view of the armored bridge-laying vehicle 1 with a single laying girder 2, which is pivotably mounted on the support ring structure 10 of the tower ring 11 via a horizontal pivot bearing 18 with the fastening means 19. The pivoting process is brought about by a piston-and-cylinder unit 20, which is connected to the laying girder 2 by means of another fastening means 21.

A plurality of telescopic U-shaped girders 3.1–3.3 are arranged within the laying girder 2, and the upper chord edges 4.1–4.3 of the telescopic U-shaped girder 3.1–3.3 are located in the same plane as the upper chord edges 5 of the laying girder 2. A feed unit 7 is flanged onto each web plate outside 6 of the laying girder 2, and at least one movably mounted support roller 8 is arranged. An arm 9 pivotable through more than 180° is arranged in the area of the laying girder. As was mentioned, the laying girder 2 is fastened to the support ring structure 10 via a horizontal pivot bearing 18. The support ring structure 10 is in turn mounted pivotably on the existing tower ring 11 of the armored bridge-laying vehicle 1. The telescopic U-shaped girders 3.1–3.3 are extended and withdrawn from and into the laying girder 2 by means of a cable winch 12 and cables.

Figure 2:
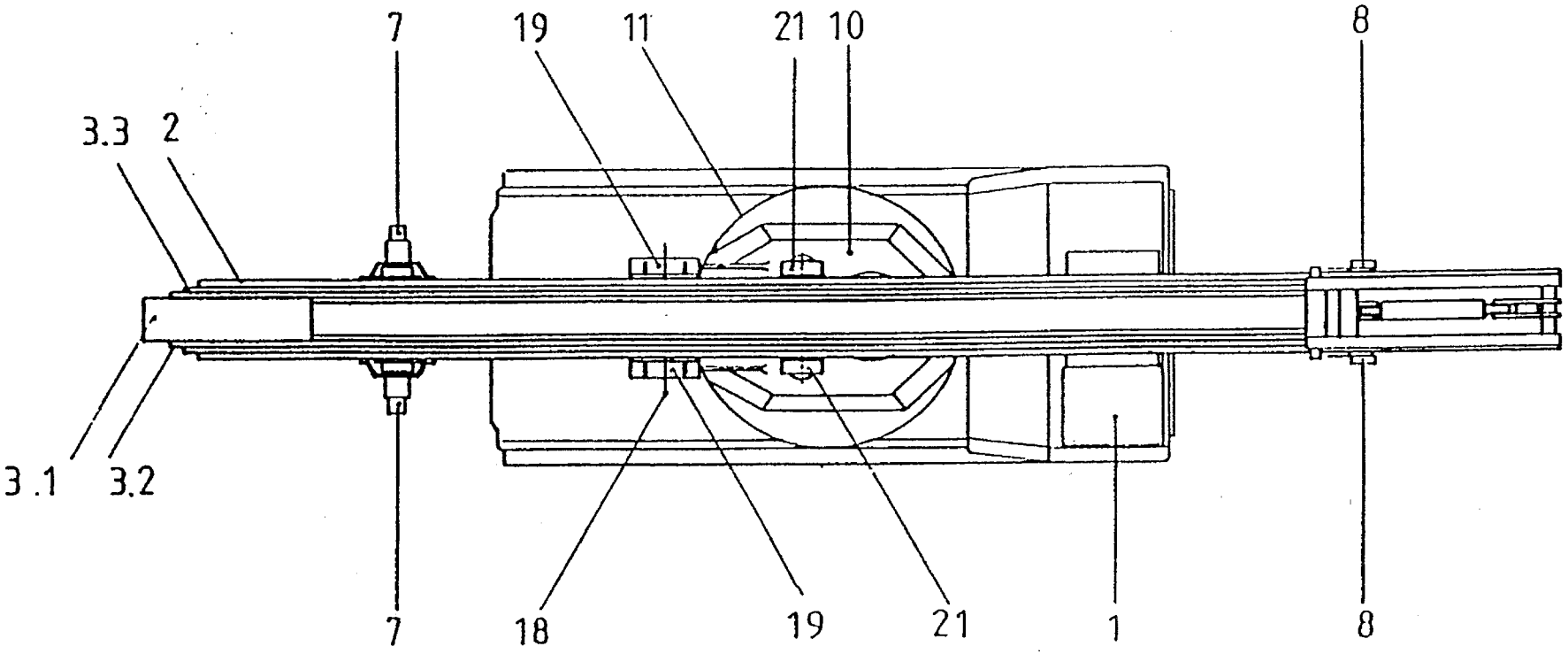
FIG. 2 is a top view of the armored bridge-laying vehicle.

The top view in FIG. 2 shows that the flanged feed units 7 and movably mounted support rollers 8 on the armored bridge-laying vehicle 1 are arranged on the laying girder 2 on the outside on both sides. The horizontal pivot bearing 18 with the rotatably mounted support ring structure 10, on the tower ring 11 of the armored bridge-laying vehicle 1, as well as the fastening means 21 of the piston-and-cylinder unit for pivoting the laying girder 2 are also fastened to the web plates 6 of the laying girder 2 on the outside.

Figure 3:
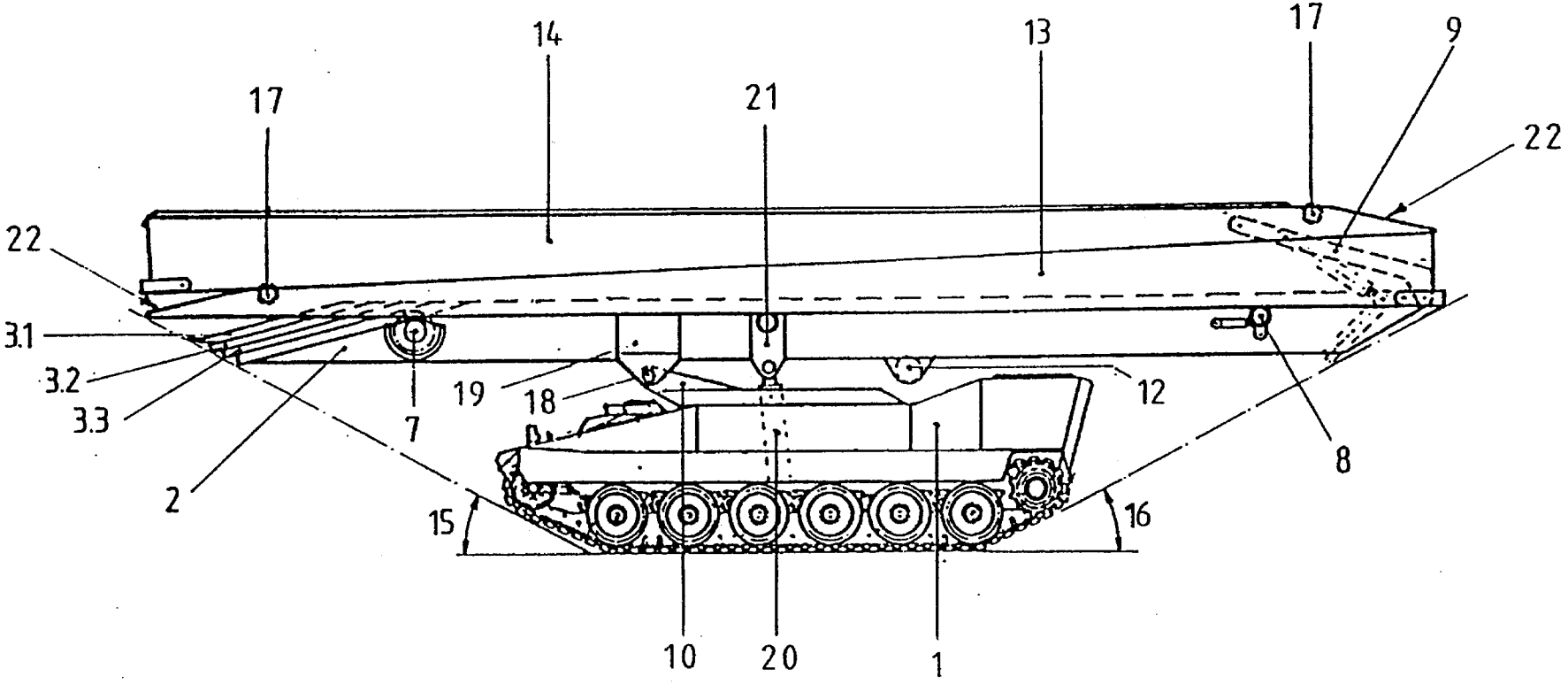
FIG. 3 is a side view of the armored bridge-laying vehicle with two bridge sections located one on top of another.

FIG. 3 shows the armored bridge-laying vehicle 1 in the transport position with two track support-like bridge sections 13, 14 one of top of another, each of which has running wheels 17 between the up ramps 22. The pivotable arm 9 and the supported bridge sections 13 and 14 are within the extension of the front and rear slope angles 15 and 16 of the traveling tracks of the armored bridge-laying vehicle 1 during the transportation of the laying girder 2 including the withdrawn telescopic U-shaped girders 3.1–3.3.

While a specific embodiment of the invention has been shown and described in detail to illustrate the application of the principles of the invention, it will be understood that the invention may be embodied otherwise without departing from such principles.

What is claimed is:

1. An armored bridge-laying vehicle, comprising: a tower ring supported on said vehicle; a support ring structure rotatably connected to said tower ring; a laying girder pivotably connected to said support ring structure; a bridge arm pivotably connected to said laying girder; a plurality of U-shaped telescopic girders displaceably arranged in said laying girder, each of said U-shaped girders and said laying girder having an upper cord edge located in a common plane.

2. An armored bridge-laying vehicle according to claim 1, further comprising: movably mounted support rollers, said laying girder including a web plate, said movably mounted support rollers being arranged at said web plate on a rear part of said laying girder.

3. An armored bridge-laying vehicle according to claim 1, wherein said arm is connected for pivotable movement through more than 180 degrees, said arm being disposed adjacent to an upper cord of said laying girder, on a rear side of said laying girder.

4. An armored bridge-laying vehicle according to claim 1, further comprising: supported bridge sections positionable in a transport position, said laying girder including said displaceably U-shaped girders in a withdrawn position, said arm, and supported bridge sections, being disposable in a transport position, said vehicle having a front wheel slope angle and a rear wheel slope angle, each of said laying girder in said transport position and said supported projections being located within said front and rear slope angles in said transport position.

* * * * *